US005209515A

United States Patent [19]

Dotson et al.

[11] Patent Number: 5,209,515

[45] Date of Patent: May 11, 1993

[54] SOLVENT AND/OR PRESSURE SENSITIVE SECURITY DOCUMENT

[75] Inventors: Mark D. Dotson; A. Dale Lakes; William H. Mowry, Jr., all of Dayton, Ohio

[73] Assignee: The Standard Register Company, Dayton, Ohio

[21] Appl. No.: 652,614

[22] Filed: Feb. 8, 1991

[51] Int. Cl.[5] ..... B42D 15/00

[52] U.S. Cl. ..... 283/95; 283/117; 283/904; 428/916

[58] Field of Search ..... 283/95, 117, 904; 428/916

[56] References Cited

U.S. PATENT DOCUMENTS

| | | | |
|---|---|---|---|
| 2,780,015 | 2/1957 | Whitehead | 283/904 |
| 4,629,630 | 12/1986 | Devrient | 283/95 X |
| 4,662,651 | 5/1987 | Mowry, Jr. | 283/95 X |
| 4,710,617 | 12/1987 | Mouchotte | 283/95 X |
| 4,725,497 | 2/1988 | Honnorat et al. | 283/95 X |
| 4,729,792 | 3/1988 | Seitz | 106/21 |
| 4,846,502 | 7/1989 | Chang et al. | 283/95 X |
| 4,898,780 | 2/1990 | Seitz | 428/402.21 |
| 5,033,773 | 7/1991 | Brunea et al. | 283/95 X |

OTHER PUBLICATIONS

Research Disclosure Nov. 1979 #18747. "Security Document".

*Primary Examiner*—Paul A. Bell

*Attorney, Agent, or Firm*—Killworth, Gottman, Hagan & Schaeff

[57] ABSTRACT

A document is provided having a solvent sensitive and/or pressure sensitive ink printed thereon which reacts to the application of a solvent and/or pressure to form a visible stain or image. The ink includes a first composition of solvent soluble, water insoluble dye particles, a binder, and optionally, an opacifier. Alternatively, the first composition may be combined with a second composition which includes an encapsulated solvent and optionally a stilting material. The first and second compositions may be printed on the document in separate steps or printed together as a self-contained composition. The ink may be printed on the entire surface of the document or only on selected areas thereof.

31 Claims, 3 Drawing Sheets

SOLVENT AND/OR PRESSURE SENSITIVE SECURITY DOCUMENT

BACKGROUND OF THE INVENTION

This invention relates to a solvent sensitive, and/or pressure sensitive ink which may be printed on security documents or other document substrates. More particularly, the invention relates to an ink containing a solvent soluble, water insoluble dye, which may be combined with an encapsulated solvent and printed on a document. When exposed to a solvent or pressure, the dye in the ink composition forms a visible stain or image on the document.

Various means have been employed in the past to aid in the prevention of fraudulent alteration of security documents. One known method is to produce a covert (i.e., initially colorless) image on a security document using a self-contained coating. A typical self-contained coating comprises an encapsulated color former such as a leuco dye with a dispersed color developer. When pressure is applied to the coating, the capsules containing the leuco dye rupture and react with the color developer, causing a color change within the impacted area. If alteration of a document is attempted by rubbing the document, the pressure causes the encapsulated dye to be released to react with the color developer, producing a clear indication of the attempted alteration.

Self-contained coatings of encapsulated color formers and dispersed color developers have also been used on business forms, or other documents such as mailers where it is desirable to selectively print information on the inside or outside of a document. Such documents are typically printed using impact printing devices in which the impact of the device causes an image to develop in a coated area on the exterior or interior portion of the document.

However, such self-contained coatings suffer from a number of disadvantages. For example, premature coloration problems may occur on the document due to the presence of free color former in the coating after encapsulation which prematurely reacts with the color developer. If such a premature coloration occurs on a security document, this may result in a genuine document being dishonored as it may appear that the document has been altered. Further, yellowing of the dispersed color developer as it is exposed to air and light may also lead to confusion. Also, typical prior art self-contained coatings must be applied as low solids containing compositions which results in higher drying requirements and sheet distortion upon drying of the solvent carrier. Finally, the use of dyestuffs encapsulated in solvents is known to produce weak colored images. If higher coat weights are used to compensate for the weak color, higher costs result because of the amount of dye required.

Another known method of protection against fraudulent alteration of security documents is to incorporate small particles of a solvent soluble, but water insoluble dye into paper, such as at the head box in a paper mill, so that the dye particles become entwined with the paper fibers. The dye particles will develop a visible stain or speckle on contact with certain solvents, or ink eradicators used by persons attempting fraudulent alterations. However, those methods require incorporation of the dye at the paper making stage. Further, the speckles are not necessarily an obvious indicator of attempted alteration. A clerk or cashier may simply believe the speckles to be part of the document background.

Accordingly, there is still a need in the art for a solvent and/or pressure sensitive ink which is cost effective to prepare, free of premature coloration problems, and produces a strong colored image or stain when exposed to solvents and/or pressure. Further, there is a need for a solvent and/or pressure sensitive ink which may be applied to security documents as a means of protection against fraudulent alteration. Still further, there is a need for a self-contained pressure sensitive ink which may be printed on document substrates as a means of forming visible images on such documents.

SUMMARY OF THE INVENTION

The present invention meets that need by providing a solvent and/or pressure sensitive ink which can be printed onto a document substrate and which forms a visible stain or image when the document is contacted with a solvent or when pressure is applied. In accordance with one embodiment of the invention, a solvent sensitive security document is provided which comprises a document substrate having first and second major surfaces. At least one of the major surfaces is printed with a composition comprising solvent soluble, water insoluble dye particles having a diameter of between about 0.3–50 μm, a binder, and optionally, an opacifier.

This embodiment of the invention provides an ink which is printed onto document substrates as either covert warning words, indicia, or as a part of a background pattern. The invention takes advantage of the fact that relatively large dye particles, i.e., particles which are about 10–50 μm in diameter, are inefficient pigments and have little color. This permits the printing of virtually invisible printed words or patterns substantially free of premature coloration problems. However, when a solvent is applied to a security document which has been printed or coated with the composition, the dye dissolves and a strong, colored visible stain or image will form on the document, indicating an attempted alteration of the document.

The ink may be printed on the document in the form of a printed background pattern or may be printed as covert warning indicia which will form a visible warning upon attempted alteration. Where the ink is printed in the form of warning indicia or words, it is preferred that dye particles having diameters of from about 30–50 μm be used to insure the covert nature of such indicia. The use of such large diameter particles may, with some printing equipment and methods, cause some difficulties. In that situation, it is preferable to use smaller diameter particles in the range of about 0.3-5 μm in combination with opacifying agents which will aid in "hiding" the warning indicia or words on the printed document.

Dyes suitable for use in the present invention include, but are not limited to, the class of solvent dyes as described in the American Textile Colorists and Chemists Color Index. Preferably, the dye should be soluble in a wide range of solvents. Suitable binders for use in the coating composition include polyvinylalcohol, polyvinylpyrrolidone, carboxymethyl cellulose, or sodium alginate. Other suitable binders include proteins such as gelatins and casein. The preferred binder is polyvinylpyrrolidone, or a combination of polyvinylpyrrolidone and casein.

As discussed above, with this embodiment of the invention, to maintain the warning indicia or words hidden on the document substrate, an opacifier may optionally be included in the composition. Suitable opacifiers include small diameter particles of titanium dioxide, corn starch, wheat starch, or polystyrene. The preferred opacifier is polystyrene beads having a diameter of less than 1.0 μm.

In another embodiment of the invention, a solvent and pressure sensitive security document is provided comprising a document substrate having first and second major surfaces. At least a portion of one of the major surfaces is printed with a first composition comprising solvent soluble, water insoluble dye particles having a diameter of between about 0.3–50 μm, a binder, and optionally, an opacifier. A second composition comprising an encapsulated solvent for the dye particles and a stilting material is printed on the security document in an overlapping but not necessarily coextensive relationship to the first composition. If desired, the first composition may be printed as covert warning words or indicia. When either a solvent or pressure is applied to an area of the document which contains both compositions, a strong, colored visible image is produced on the document. Further, if a solvent is applied to any portion of the document containing the first composition, a visible image is produced.

In yet another embodiment of the invention, the first composition is printed on at least one of the major surfaces of the document substrate and the second composition is printed on a selected portion of the first composition. When a solvent is applied to a portion of the document substrate which contains the first composition, a visible image is formed. When either pressure or a solvent is applied to the portion of the document containing both the first and second coating compositions, a visible image is also produced.

The binder used in the first coating composition may include polyvinylalcohol, polyvinylpyrrolidone, carboxymethyl cellulose, sodium alginate, and proteins such as gelatin and casein. Polyvinylpyrrolidone is the preferred binder.

An opacifier such as particles of titanium dioxide, corn starch, wheat starch, or preferably polystyrene beads is also included in the first coating composition.

A stilting material for protecting the solvent capsules from premature damage is included in the second composition which may include the use of aluminum trihydrate, corn starch, or wheat starch. The preferred stilting material is corn starch.

The encapsulated solvent may include any solvent capable of solvating the dye contained in the first composition. The preferred solvent for encapsulation is diisopropylnaphthalene.

In yet another embodiment of the invention, the first and second compositions may be applied to a security document as a self-contained coating comprising the solvent soluble, water insoluble dye particles, binder, opacifier (optional), encapsulated solvent, and stilting material. Thus, when either a solvent or pressure is applied to the document which contains the single coating composition, the dye will dissolve to produce a visible stain or image on the document. The composition may be applied as a uniform coating covering all or a portion of a document surface or it may be printed on the document in a pattern such as indicia.

The solvent and pressure sensitive ink of the present invention may also find use as a self-contained coating for a variety of business uses. In this embodiment of the invention, a solvent and pressure sensitive ink for use on a document substrate is provided comprising a self-contained composition comprising the solvent soluble, water insoluble dye, binder, opacifier (optional), stilting material, and encapsulated solvent. The dye is dissolved by the encapsulated solvent upon the impact of an imaging device to form a visible image on the document. Such a self-contained composition may be used on documents such as mailers or business forms as a means of developing images on the interior or exterior of the documents with the use of an imaging device such as a printer or typewriter but without the premature coloration problems of prior art self-contained coatings.

Accordingly, it is an object of the present invention to provide a solvent and/or pressure sensitive security ink which can be printed onto a surface of a security document or document substrate and which will produce a strong colored image or stain when a solvent or pressure is applied to the document. It is a further object of the present invention to provide a solvent and/or pressure sensitive ink which is substantially free from premature coloration problems. It is yet another object of the present invention to provide a self-contained pressure sensitive ink composition which may be printed on document substrates. These and other objects and advantages of the invention will become apparent from the following detailed description, the accompanying drawings, and the appended claims.

DETAILED DESCRIPTION OF THE PREFERRED EMBODIMENT

Figure 1:
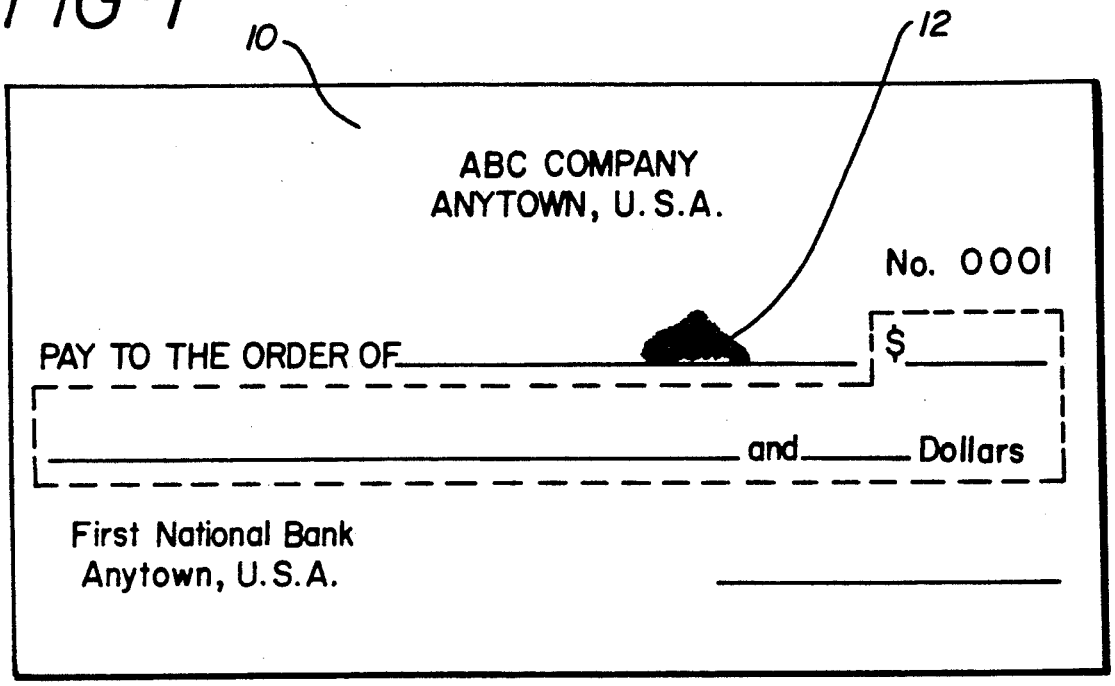
FIG. 1 is a plan view of a security document illustrating the first coating composition of the present invention.

The solvent sensitive and/or pressure sensitive ink of the present invention may be printed onto checks, money orders, negotiable certificates or documents of value or indicating value for which there is a need to protect the document against unauthorized alteration. The solvent and pressure sensitive ink may also be printed as a self-contained imaging composition on document substrates such as mailers, multiple sheet business forms, or any other documents where it is desirable to selectively print information on a document. The document substrate may be paper or other printable material.

Dyes suitable for use in the present invention include the class of dyes identified as solvent dyes by the American Textile Colorists and Chemists Color Index. Preferred dyes are those having high tinctorial strength, total water insolubility, and solubility in a wide range of solvents.

The binder used in the coating composition is added to enhance the quality of the words, indicia, or patterns printed on the document substrate and to initially disperse the dye particles in the ink vehicle. Suitable binders include various polymer latexes such as styrene, styrene-butadiene, ethylene-maleic anhydride, polyvinylalcohol, polyvinylpyrrolidone, carboxymethyl cellulose, sodium alginate, or proteins such as gelatin and casein. Binders containing hydroxy functionalities may cause premature coloration of certain dyes printed on the security paper. Accordingly, the preferred binder for use in the present invention is polyvinylpyrrolidone, alone or in conjunction with casein. Polyvinylpyrrolidone is commercially available from GAF Corporation under the designations K30 or K90 and has an absence of hydroxy functional groups. Moreover, the addition of a strong base such as ammonia to the binder will act to block any hydroxy functionality and prevent premature solvation and coloration of the dye. The ammonia may be added while the security ink is in a wet state and is later driven off when the coating is dried. Once dried, the immobilized dye particles have limited contact with any hydroxy groups in close proximity.

The coating composition optionally includes an opacifier to help conceal the dye particles when they are printed on the document substrate. The opacifier may include particles of aluminum trihydrate, titanium dioxide, corn starch, wheat starch, or polystyrene beads. The preferred opacifier is hollow polystyrene beads, which are available from Rohm and Haas under the name Ropaque OP84 or solid polystyrene beads from The Dow Chemical Company under the designation DOW 6622. The use of an opacifier is particularly preferred when the ink is printed as warning words and/or when the diameter of the dye particles is less than about 10 μm.

When an encapsulated solvent is included in the ink, a stilting material such as corn starch is preferably included in addition to the opacifier. The corn starch particles act to protect the encapsulated solvent against rubbing or abrasion which would result in premature capsule rupture and coloration on the document.

As can be seen in the drawing figures, the solvent and/or pressure sensitive ink may be printed on the entire document, or only in selected portions, such as the area in which a signature or dollar amount is visible. It should be appreciated that many different combinations for placement of the compositions on a security document are possible and are within the scope of this invention.

As illustrated in FIG. 1, the first composition 10 which contains the solvent sensitive, water insoluble dye particles is printed or coated on the entire surface of the security document. When a solvent is applied to the document in an attempted alteration, it will dissolve the dye particles causing a visible stain 12 to form.

Figure 2:
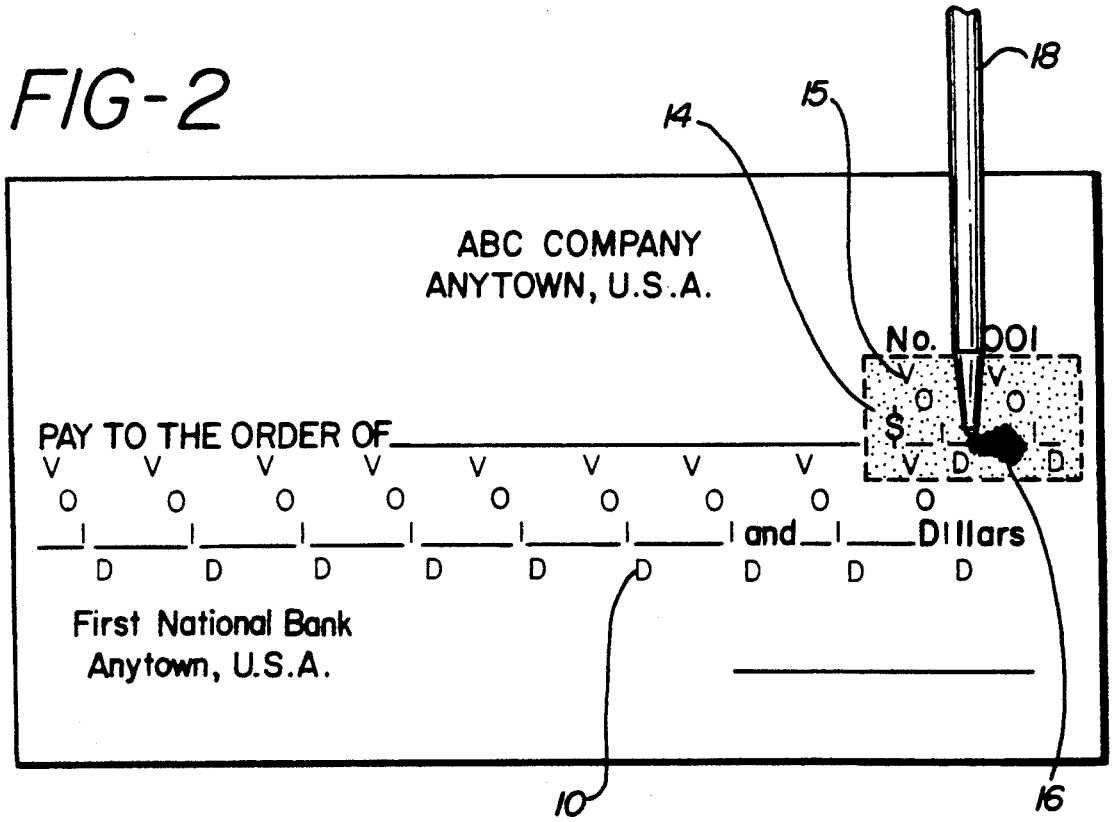
FIG. 2 is a plan view of a security document illustrating the single coating comprising the first and second coating compositions of the present invention.

FIG. 2 illustrates a solvent and pressure sensitive security document which comprises first composition 10 containing the solvent sensitive, water insoluble dye particles printed in the form of warning indicia, and second composition 14 containing encapsulated solvent. The second composition is printed only in the area containing the dollar amount on the check. If alteration of that portion of the document is attempted with the use of a writing instrument 18 or attempted erasure, the encapsulated solvent in the second coating composition will be released and will dissolve the solvent sensitive dye particles in the first composition to form a visible stain 16 and produce a clear indication of attempted alteration. Likewise, if a solvent is applied to the document within the same area, it will dissolve the solvent sensitive dye particles and form the warning word 15.

Figure 3:
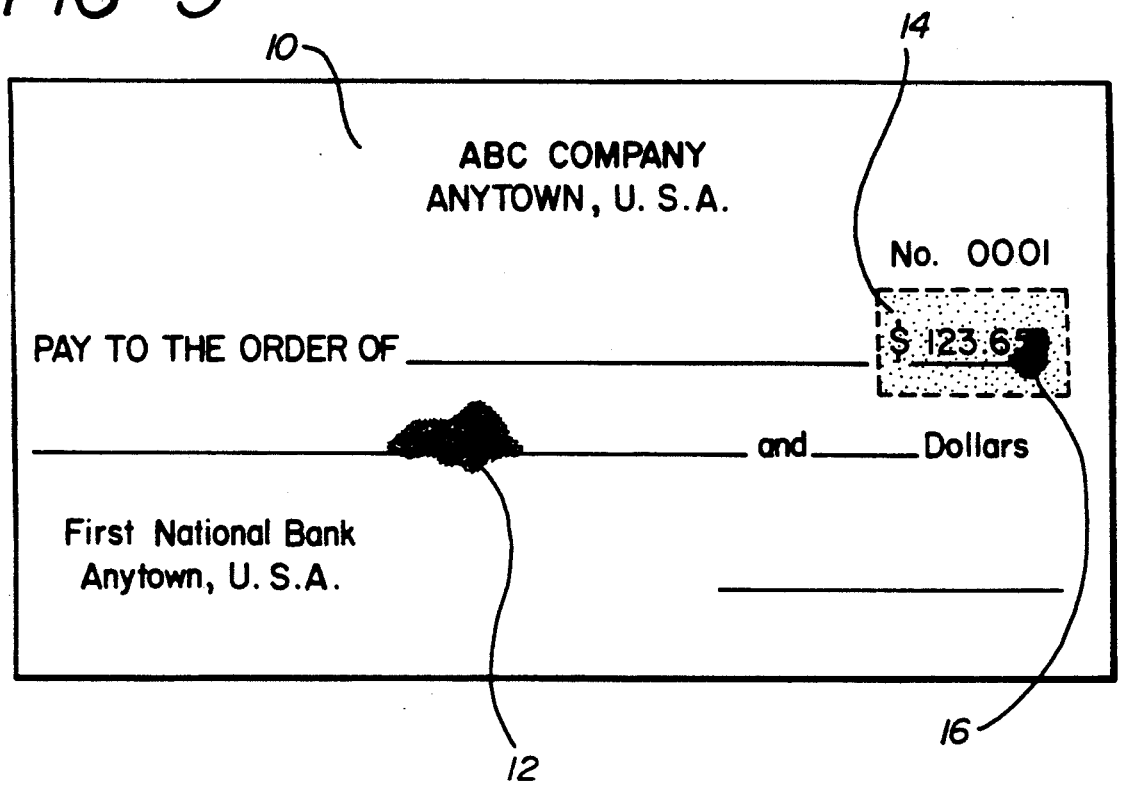
FIG. 3 is a plan view of a security document illustrating alternative positioning of the first and second coating compositions.

FIG. 3 illustrates an alternate Positioning of the ink compositions on a security document. The first composition 10 containing the solvent sensitive, water insoluble dye particles is printed or coated over the entire document surface while second composition 14 containing encapsulated solvent is printed only in the area containing the dollar amount. When a solvent is applied to any portion of the document, it will dissolve the solvent sensitive dye particles in the first composition to form a stain 12. If alteration is attempted by erasure of the document in the area containing the dollar amount, the encapsulated solvent contained in the second composition will be released and solubilize the dye particles in the first composition to form a stain 16.

Figure 4:
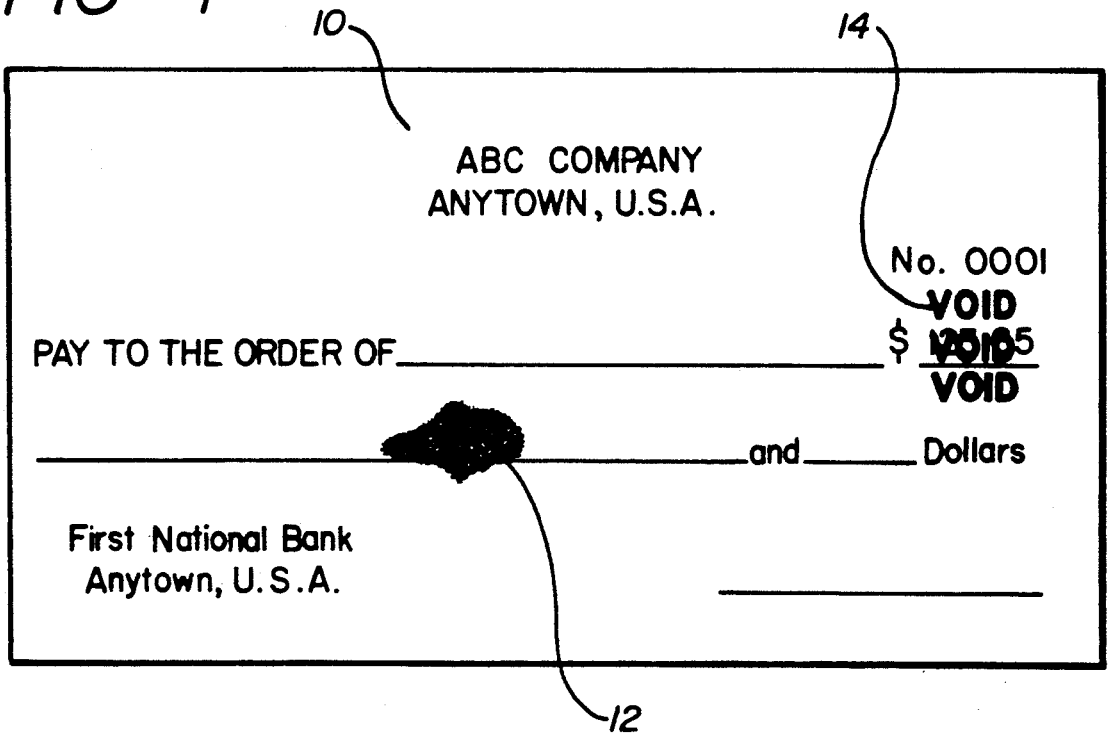
FIG. 4 is a plan view of a security document illustrating the first and second coating compositions, with the first coating composition printed in the form of warning indicia.

As illustrated in FIG. 4, the first composition 14 may be printed as covert warning indicia using the words "void" in close proximity to the dollar amount on the document over the second composition 10 which contains the encapsulated solvent. When a solvent or pressure is applied to the paper where the covert indicia have been printed, the dye dissolves and the warning words become visible.

Figure 5:
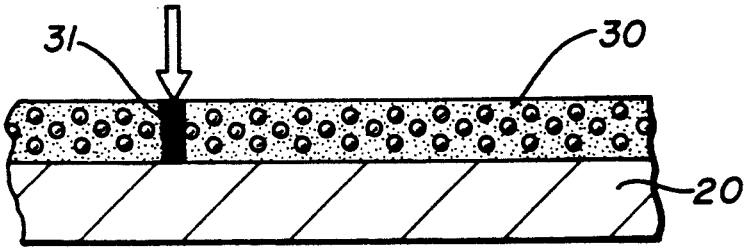
FIG. 5 is a fragmentary sectional view of a document substrate illustrating the self-contained imaging composition of the present invention.

FIG. 5 illustrates a document substrate 20 which has been coated with a self-contained composition 30 comprising the solvent soluble, water insoluble dye, binder, opacifier (optional), stilting material, and encapsulated solvent. The coating may be substantially continuous or cover only a portion of the substrate.

When an imaging device, indicated by the arrow, applies pressure to the surface of the substrate containing the self-contained composition 30, a visible image 31 is formed in the area beneath the imaging device which is covered by the coating. When the imaging device applies pressure to an area outside the coating 30, no image is formed. It should be appreciated that the self-contained composition may also be applied to a multi-sheet business form or mailer in which the composition is spot coated or printed onto selected portions of the interior and/or exterior portions of the business form.

The encapsulated solvent should be compatible with the dye so that when released, the solvent will dissolve the dye and form a colored image on the document. The preferred encapsulated solvent is diisopropylnaphthalene because it is capable of solvating most solvent-soluble dyes and it can be encapsulated without any residual solvent remaining outside the capsules. Any of a number of known encapsulation techniques may be utilized including the procedures taught in U.S. Pat. Nos. 4,898,780 and 4,729,729, as well as commonly known techniques such as coacervation, melamine-formaldehye, or polyurea. The preferred capsule size is from about 3 μm to 7 μm.

Preferred solvent soluble, water insoluble dyes are Solvent Blue 4 and Solvent Red 4. Solvent Blue 4 has a C.I. Color Index Number 44045:1 and Solvent Red 24 (Sudan IV) has a C.I. Color Index Number 26105. Both of these dyes are preferred because of their complete water insolubility as well as their ability to impart strong color on a substrate when dissolved.

If printed as indicia, the dye particles in the ink should be preferably from 10 to 50 μm in size so that the printed words formed by the dye remain virtually invisible until contacted with a solvent. If the dye is to be printed as visible background patterns or images, the dye particles are preferably from 3 to 10 μm in size. Use of smaller dye particles increases the ability of the dye particles to be seen when printed as a visible pattern on the document background. Use of an opacifier in conjunction with the dye particles is preferred for this embodiment when initial visibility of the ink is not desired.

When the ink composition combines an encapsulated solvent with a solvent sensitive dye, and the ink is printed as a background over the surface of the document substrate either as a uniform continuous coating or as images, the dye is preferably comprised of particles having a size of from 8–15 μm so that the dye does not absorb much light and the background color of the document remains light in color.

The dye is present in the composition at a weight of about 0.05 to 1.0% for a wet coating. Because the dye may be put into the headbox at the paper mill for full-coating applications, and because a low level of dye is required to achieve a good colored image, the ink of the present invention may be produced more cost effectively than other conventional methods.

The ink may be printed onto security documents by a number of conventional techniques. Such techniques include flexography, direct gravure, and screen for applying images and such methods as blade and reverse roll for continuous coating. If used on security documents, the ink is preferably applied to the document substrate at a coating weight of between about 0.5 and 1.5 lbs/17×22×500 sheet ream. The ink may be printed as a repeating pattern on the entire surface of stock safety papers during the manufacturing process. Alternatively, selected areas of a security document may be printed with the ink during the printing process.

If used as a self-contained coating, the ink is preferably applied to a document substrate at a coating weight of between about 1.0 and 2.0 lbs/17×22×500 sheet ream.

In order that the invention may be more readily understood, reference is made to the following examples which are intended to illustrate the invention, but not limit the scope thereof.

EXAMPLE 1

Preparation of Dye/Binder Dispersion

A solvent sensitive security ink in accordance with the present invention was prepared by adding 300 g. water, 30 g. polyvinylpyrrolidone (K30 available from GAF Corporation), 1 g. ammonia, and 1 pound ⅛" stainless steel shot to a 500 g. attritor. The attritor was operated at 100% speed, and 33 g. Solvent Blue 4 was added to the vortex. After the dye was dispersed, the speed of the attritor was reduced to 60%. The resulting particle size was 4–6 μm as measured by a Coulter Particle Counter.

EXAMPLE 2

The encapsulated solvent was prepared in accordance with teachings contained in U.S. Pat. No. 4,898,780, the disclosure of which is incorporated herein by reference:

Solution A 960 g. of diisopropyl naphthalene was added to a 2 liter beaker. At room temperature 98.5 g. Desmodur L2291A (a biuret-containing polyisocyanate made by Mobay Chemical Corp., Pittsburgh, Pa.) was added and stirred until a clear solution was obtained.

Solution B

In a four liter beaker, 135 g. casein was added to 1.7 liters water. The solution was heated to 80°–85° C., held for 30 minutes, and then cooled to 60° C. 20.25 g. of Borax was added, the solution was stirred for 15 minutes, and then cooled to room temperature. The solution was then placed in a Waring blender connected to a variac. With the blender set on high and the variac at 50%, Solution A was poured slowly into the vortex of Solution B over a period of two minutes. After the addition of Solution A was complete, the variac was set to 100%, and the blender allowed to run for 30 seconds. The emulsion was transferred to the four liter beaker, and stirred moderately to produce a slight vortex. Then, 15 grams diethylene triamine in 15 grams water was added to the emulsion. The mixture was heated to 60° C. and held at that temperature for about two hours. The capsule slurry was cooled to room temperature. The average capsule size produced was about 7 microns.

EXAMPLE 3

To obtain the single coating comprising the encapsulated solvent and solvent sensitive ink, the encapsulated solvent prepared in Example 2 was combined with the solvent senstive dye prepared in Example 1. The following weight percentages were used: 50% capsules (from Example 2), 10% corn starch, 5% Solvent Blue 4 (from Example 1), 7% PVP K30, 0.5% PVP K90, 5% ammonium hydroxide, and 22.5% Ropaque OP84 hollow polystyrene beads.

EXAMPLE 4

In accordance with the present invention, a solvent sensitive ink was prepared to be used in the form of a printed background pattern on the security document. The ink was prepared according to the method of Example 1 using the following components: 79% water, 1% ammonia, 10% PVP K30, and 10% Solvent Blue 4 ground to 3–5 μm and dispersed in 10% PVP K30.

EXAMPLE 5

In accordance with the present invention, a solvent sensitive ink was prepared for printing warning indicia on a security document. The ink was prepared according to the method of Example 1 using the following components: 67% water, 1% ammonia, 10% polyvinylpyrrolidone, 12% Ropaque OP84, and 10% Solvent Blue 4 ground to 10–20 μm in 10% PVP K30.

Having described the invention in detail and by reference to preferred embodiments thereof, it will be apparent that modifications and variations are possible without departing from the scope of the invention defined in the appended claims.

What is claimed is:

1. A solvent sensitive security document comprising a document substrate having a first and second major surfaces, at least one of said major surfaces having coated or printed thereon a composition comprising solvent soluble, water insoluble dye particles having a diameter of between about 0.3–50 μm, and a binder, said dye particles solubilizing when contacted with a solvent to form a colored visible stain or image on said substrate to indicate an attempted alteration of said document.

2. The security document of claim 1 in which said dye particles are comprised of particles having a diameter of between about 10–50 μm.

3. The security document of claim 1 in which said binder is selected form the group consisting of polyvinylpyrrolidone, proteins, and mixtures thereof.

4. The security document of claim 1 in which an opacifier is present and said dye particles have a diameter of between about 3-5 μm.

5. The security document of claim 4 in which said opacifier is selected from the group consisting of titanium dioxide, corn starch, wheat starch, or polystyrene.

6. The security document of claim 1 in which said composition is printed on said document substrate in the form of a background image pattern.

7. The security document of claim 1 in which said composition is printed on said document substrate in the form of covert warning indicia.

8. A solvent and pressure sensitive document comprising:

a document substrate having first and second major surfaces;

a first composition comprising solvent soluble, water insoluble dye particles having a diameter of between about 0.3-50 μm, and a binder, said first composition being printed or coated on a selected portion of one of said major surfaces of said document substrate; and a second composition comprising an encapsulated solvent for said dye particles printed on said first coating in an overlapping relationship;

whereby the application of a solvent or pressure to the area of said document containing said first and second compositions produces a colored visible stain or image thereon.

9. The document of claim 8 in which said dye particles have a diameter of between about 10-50 μm.

10. The document of claim 8 wherein said binder is selected from the group consisting of polyvinylpyrrlidone, proteins, and mixtures thereof.

11. The document of claim 8 wherein an opacifier is present and said dye particles have a diameter of between 3-5 μm.

12. The document of claim 11 in which said opacifier is selected from the group consisting of particles of titanium dioxide, corn starch, wheat starch, or polystyrene.

13. The document of claim 8 wherein said second composition includes a stilting material.

14. The document of claim 13 wherein said stilting material is selected from the group consisting of wheat starch, corn starch, or aluminum trihydrate.

15. The document of claim 8 wherein said first composition is printed in the form of covert warning indicia.

16. The document of claim 8 wherein said encapsulated solvent is diisopropylnaphthalene.

17. A solvent and pressure sensitive document comprising:

a document substrate having first and second major surfaces;

a composition printed or coated on a selected portion of one of said major surfaces, said composition comprising solvent soluble, water insoluble dye particles having a diameter of between about 0.3-50 μm, and a binder, and an encapsulated solvent;

whereby the application of a solvent or pressure to the area of said document containing said coating produces a colored visible stain or image thereon.

18. The document of claim 17 in which said dye comprises particles having a size of from 8-15 μm.

19. The document of claim 17 wherein said binder is selected from the group consisting of polyvinylpyrrolidone, proteins, and mixtures thereof.

20. The document of claim 17 wherein said composition includes an opacifier comprising polystyrene beads.

21. The document of claim 17 wherein said composition includes a stilting material.

22. The document of claim 21 in which said stilting material is selected from the group consisting of wheat starch, corn starch, or aluminum trihydrate.

23. The document of claim 17 wherein said coating is printed in the form of covert warning indicia.

24. The document of claim 17 wherein said encapsulated solvent is diisopropylnaphthalene.

25. A solvent and pressure sensitive document comprising:

a document substrate having first and second major surfaces;

a first coating composition comprising covert, solvent soluble, water insoluble dye particles having a diameter of between about 0.3-50 μm, and a binder, said composition deposited on the entire surface of at least one of said major surfaces of said document substrate;

a second coating composition comprising an encapsulated solvent and a stilting material, said composition deposited on a selected portion of said first coating;

whereby the application of a solvent to any portion of the surface of said document substrate produces a colored visible stain or image thereon and wherein the application of pressure or a solvent to the portion of said document substrate containing both said first and second coatings produces a colored visible stain or image.

26. The security document of claim 25 in which said dye comprises particles having a size of from 8-15 μm.

27. The security document of claim 25 wherein said binder is selected from the group consisting of polyvinylpyrrolidone, proteins, and mixtures thereof.

28. The security document of claim 25 wherein said first coating composition includes an opacifier comprising polystyrene beads.

29. The security document of claim 25 in which said stilting material is selected from the group consisting of wheat starch, corn starch, and aluminum trihydrate.

30. The security document of claim 25 wherein said first coating composition is printed in the form of covert warning indicia.

31. The security document of claim 25 wherein said encapsulated solvent is diisopropylnaphthalene.

* * * * *